US007219974B2

(12) United States Patent
Roman et al.

(10) Patent No.: US 7,219,974 B2
(45) Date of Patent: May 22, 2007

(54) MEASUREMENT OF FLUID CONTINUITY IN A FLUID CARRYING MEMBER

(75) Inventors: Justin Roman, Menlo Park, CA (US); Martin G. Rockwell, Sherwood, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 96 days.

(21) Appl. No.: 11/042,919

(22) Filed: Jan. 24, 2005

(65) Prior Publication Data

US 2005/0134628 A1 Jun. 23, 2005

Related U.S. Application Data

(63) Continuation of application No. 10/272,697, filed on Oct. 16, 2002, now Pat. No. 6,886,901, which is a continuation of application No. 09/773,179, filed on Jan. 30, 2001, now Pat. No. 6,685,295.

(51) Int. Cl.
*B41J 2/195* (2006.01)

(52) U.S. Cl. ..... 347/19; 347/7

(58) Field of Classification Search ..... None
See application file for complete search history.

(56) References Cited

U.S. PATENT DOCUMENTS 4,368,478 A * 1/1983 Koto ..... 347/86
5,427,136 A * 6/1995 Weishew ..... 137/392
5,775,164 A * 7/1998 Kishi ..... 73/304 R
6,223,595 B1 * 5/2001 Dumbovic et al. ..... 73/295

* cited by examiner

*Primary Examiner*—Thinh Nguyen
(74) *Attorney, Agent, or Firm*—Gregg W. Wisdom

(57) ABSTRACT

In an inkjet printer using ink reservoirs located physically remote from the print heads, tubes are used to deliver ink from the ink reservoirs to the print heads. Air initially present within the tubes can interfere with the proper operation of the print heads and cause print head reliability problems Additionally, air present within the tubes can interfere with the proper flow of ink from the ink reservoirs to the print heads through the tubes. An embodiment of a fluid continuity measurement apparatus includes current sources for each of the tubes. Each of the current sources delivers a substantially constant current to the corresponding tube. Voltage measurement circuits are coupled across each of the tubes. Each of the voltage measurement circuits generates an output corresponding to the voltage across the corresponding tube. The voltages appearing between the ends of the tubes changes as the volume of the air within the tubes changes. Increasing the volume of air within the tubes increases the resistance of the tubes thereby increasing the voltages resulting from the application of a substantially constant current. A controller coupled to the output of the voltage measurement circuits compares each of the voltages output from the voltage measurement circuits to an empirically determined threshold value to determine if the volume of air within the tubes has reached an unacceptable level.

2 Claims, 9 Drawing Sheets

| LENGTH OF AIR IN TUBE | VOLTAGE ACROSS TUBE | LENGTH OF INK IN TUBE |
|---|---|---|
| 3.5 INCHES | 6.5 VOLTS | 31 INCHES |
| 7.5 INCHES | 5.0 VOLTS | 27 INCHES |
| 13 INCHES | 4.3 VOLTS | 21.5 INCHES |
| 26 INCHES | 3.7 VOLTS | 8.5 INCHES |
| 29.5 INCHES | 3.1 VOLTS | 5.0 INCHES |
| 34.5 INCHES | 2.8 VOLTS | 0.0 INCHES |

MEASUREMENT OF FLUID CONTINUITY IN A FLUID CARRYING MEMBER

CROSS REFERENCE TO RELATED APPLICATIONS

This is a continuation of application Ser. No. 10/272,697 filed on Oct. 16, 2002 now U.S. Pat. No. 6,886,901, which is a continuation of issued U.S. Pat. No. 6,685,295, having application Ser. No. 09/773,179 filed on Jan. 30, 2001 now U.S. Pat. No 6,685,295, each of which are hereby incorporated by reference herein.

FIELD OF THE INVENTION

This invention relates to the measurement of fluid continuity in the fluid inside of a fluid carrying member.

BACKGROUND OF THE INVENTION

In a certain class of imaging devices, known as off axis inkjet printers, liquid colorant is delivered from a reservoir to an imaging head through a fluid carrying member, such as a tube. The reservoir and the imaging head are separated to reduce the mass of the imaging head and allow lower cost replenishment of the ink in the inkjet printer. Through a variety of ways, voids can form in the liquid colorant. These voids can interfere with the proper working of the imaging head. Another possible problem is that replacement of an ink reservoir is done improperly so that liquid colorant cannot flow from the reservoir to the imaging head. A need exists for a method and apparatus to detect voids within a fluid carrying member.

SUMMARY OF THE INVENTION

Accordingly, in an imaging device an apparatus for measuring a parameter related to a flow of power through a fluid within a member includes a power source arranged to supply the power to the fluid within the member. In addition, the apparatus includes a measurement device configured to measure the parameter and generate a corresponding signal.

In an imaging device, a method for measuring continuity of a fluid, includes applying power to the fluid within a member and measuring a parameter related to a flow of power through the fluid. In addition, the method includes generating a signal corresponding to the parameter.

An inkjet imaging device includes an imaging mechanism configured to place ink onto media using a print head. In addition, the inkjet imaging device includes a container for holding the ink and a fluid carrying member coupled between the container and the print head. The inkjet imaging device also includes a controller coupled to the imaging mechanism and configured to generate signals used by the imaging mechanism to place the colorant onto the media. Furthermore, the inkjet imaging device includes a power source configured to supply power to the ink within the fluid carrying member and a measurement device configured to measure a parameter related to a flow of the power through the ink.

DESCRIPTION OF THE DRAWINGS

A more thorough understanding of embodiments of the fluid continuity measurement apparatus may be had from the consideration of the following detailed description taken in conjunction with the accompanying drawings in which:

Shown in FIG. 1 is a simplified diagram of an embodiment of the fluid continuity measurement apparatus.

Shown in FIGS. 2A–2I are alternative embodiments of the fluid continuity measurement apparatus.

Figure 3A:
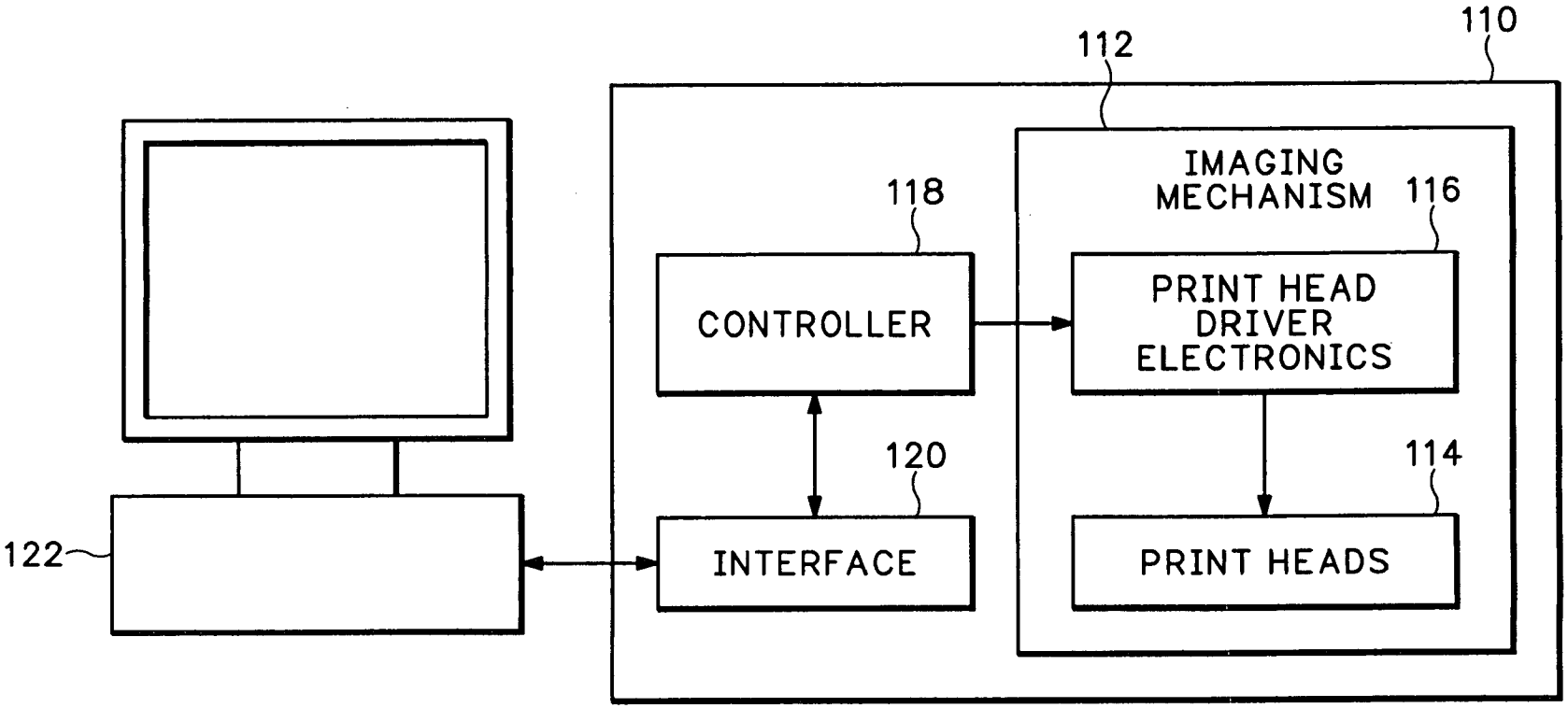

Shown in FIG. 3A is a high level block diagram of an inkjet imaging device.

Figure 3B:
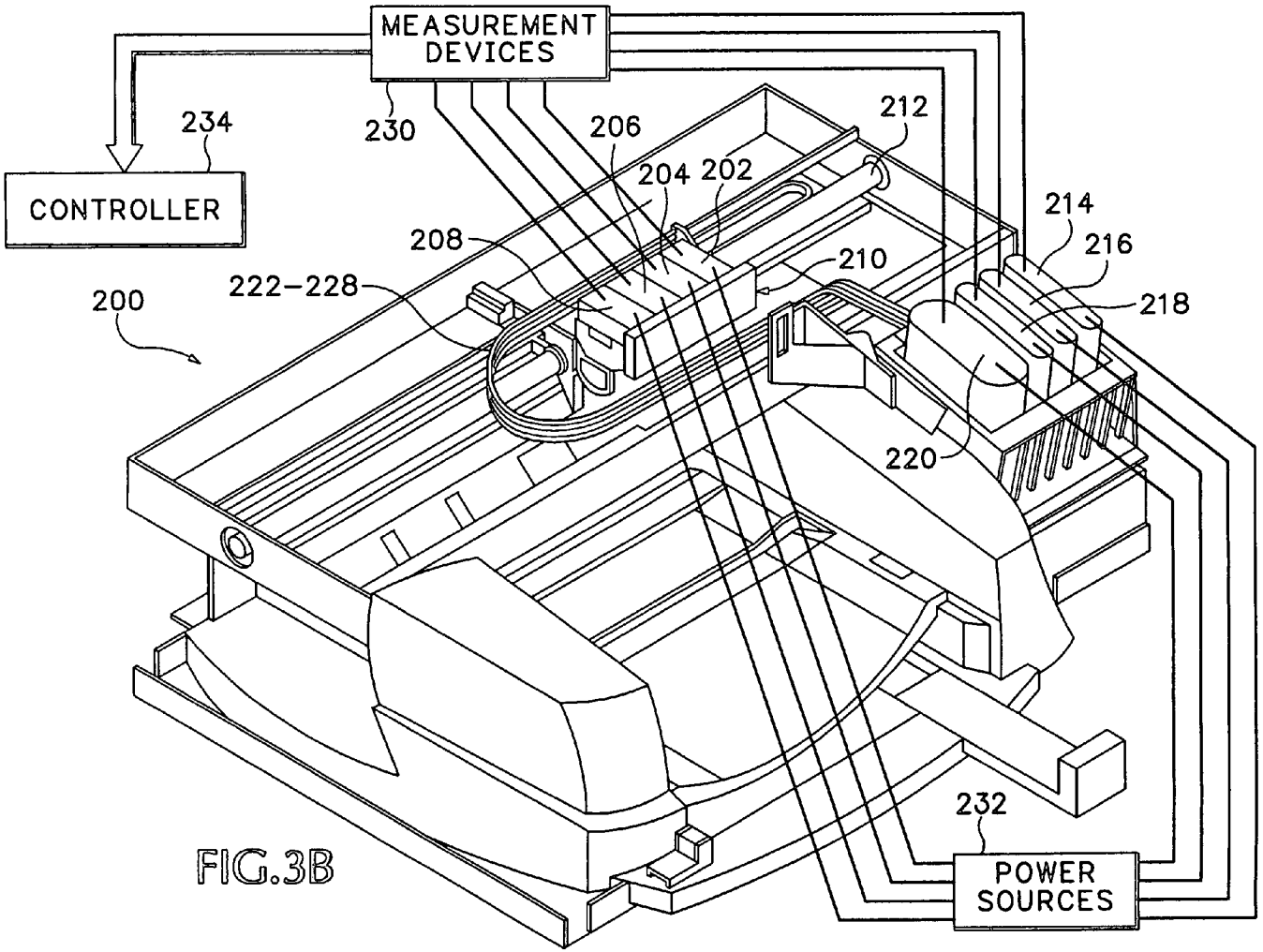

Shown in FIG. 3B is an exemplary inkjet imaging device.

Figure 4:
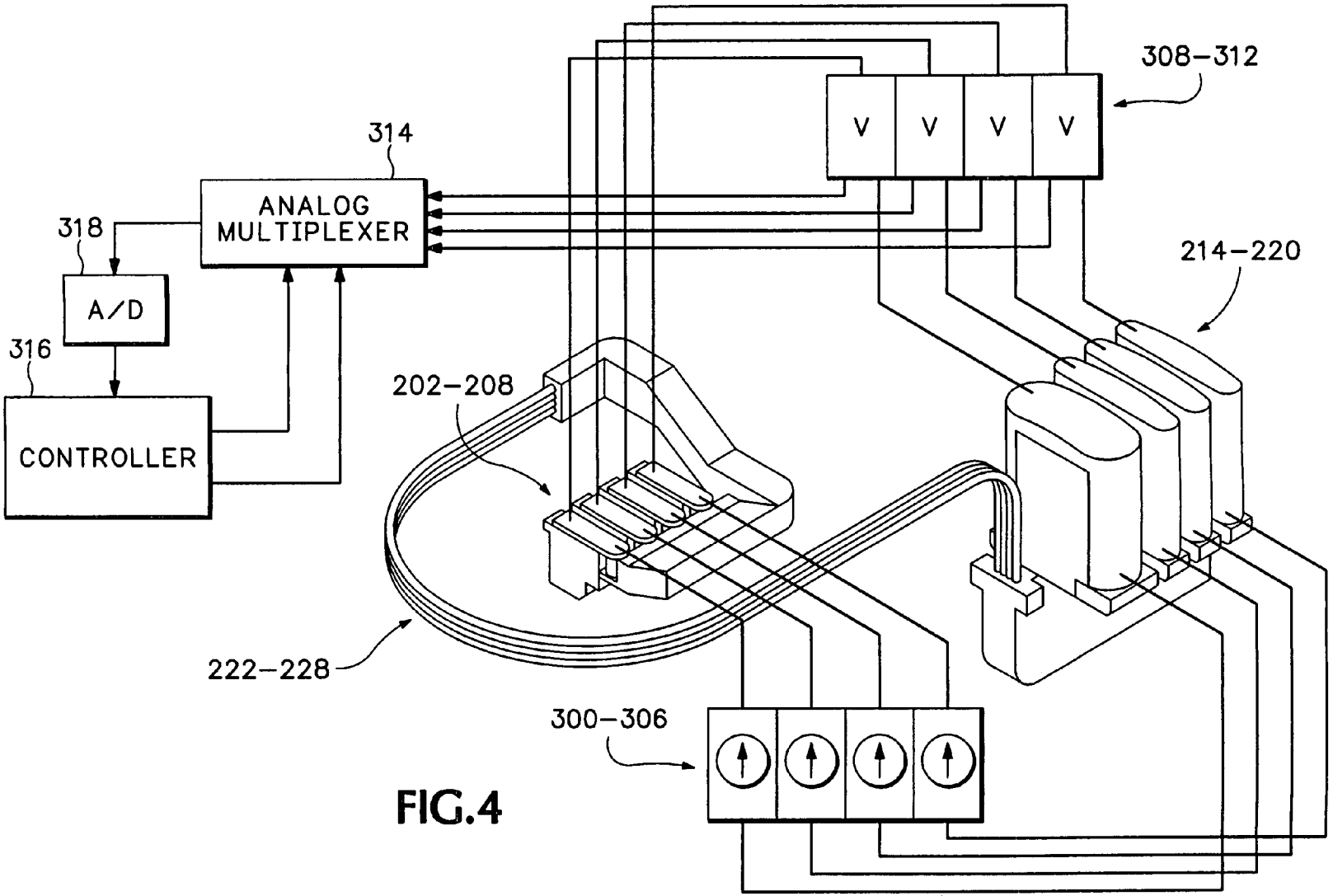

Shown in FIG. 4 are assemblies from the inkjet imaging device of FIG. 3B.

Figures 5A, 5B:
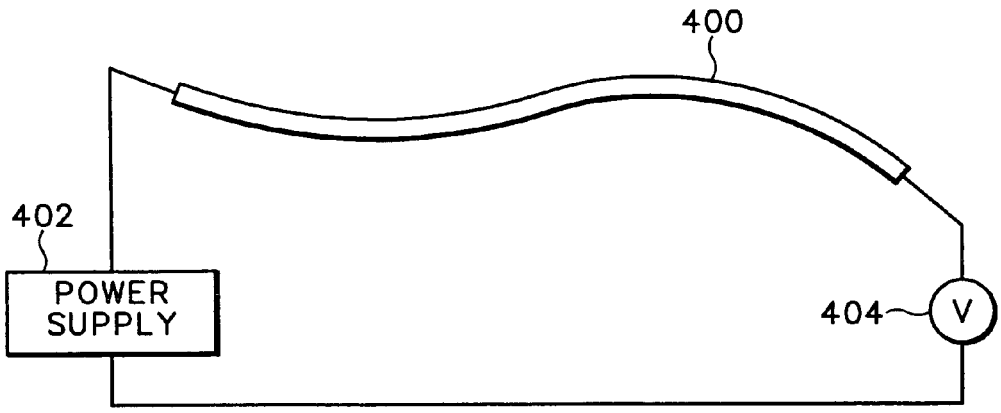

Shown in FIG. 5A is a circuit configuration used to measure the voltage across an ink filled tube as the volume of ink within in the tube changes.

Shown in FIG. 5B is a table including measurement data obtained using the circuit configuration shown in FIG. 5A.

DETAILED DESCRIPTION OF THE DRAWINGS

Although an embodiment of the fluid continuity measurement apparatus will be discussed in the context of detecting an absence of continuity between an ink reservoir and a print head or a decrease in the ability of ink to easily move in a tube between an ink reservoir and a print head in an inkjet printer, it should be recognized that the disclosed principles are broadly applicable. For example, an embodiment of the fluid continuity measurement apparatus could be used in an application in which it is important to deliver a fluid at a substantially constant rate through a fluid carrying member. The embodiment of the fluid continuity measurement apparatus would detect the presence of voids in the fluid inside of the fluid carrying member and signal a controller. In response to receiving the signal, the controller would either stop dispensing fluid through the fluid carrying member or generate a warning that the fluid dispensing is not being performed correctly.

Figure 1:
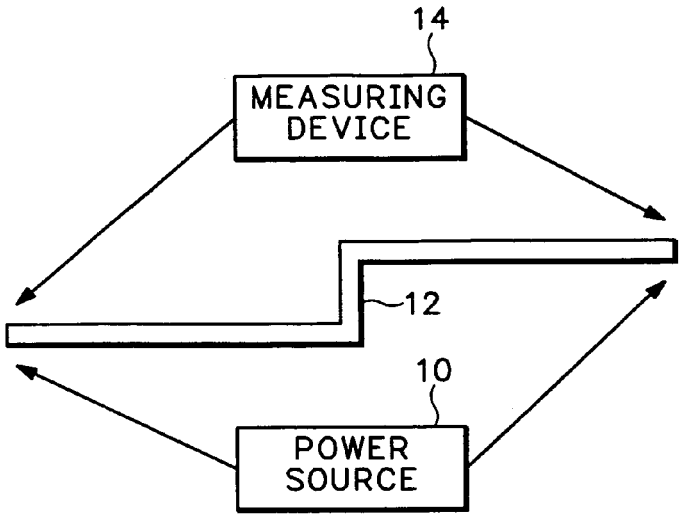

Shown in FIG. 1 is a simplified diagram of an embodiment of the fluid continuity measurement apparatus. A power source, such as electric power source 10, provides electric energy to fluid carrying member 12. In FIG. 1, electric power source 10 is shown as delivering electric power to fluid carrying member 12 in a general fashion. That is, the coupling of electric power source 10 to fluid carrying member 12 shown in FIG. 1 could be implemented in a wide variety of specific ways depending upon the type of electric power source used and the circuit configuration in which it is used. The electric energy supplied could be substantially constant with respect to time or it could be time varying. Fluid carrying member 12 is adapted to carry a fluid. The fluid inside of fluid carrying member 12 is at least somewhat conductive. A measuring device, such as measuring device 14, measures a parameter related to the flow of electrical energy through the fluid included within fluid carrying member 12. The measuring device 14 generates a signal corresponding to the parameter measured by measuring device 14. In FIG. 1, measuring device 14 is shown as measuring the parameter related to the flow of electrical energy in a general fashion. That is, the coupling of measuring device 14 to fluid carrying member 12 shown in FIG. 1 could be implemented in a wide variety of specific ways depending upon the type of measuring device used and the circuit configuration in which it is used. If the continuity of fluid present in fluid carrying member 12 is obstructed, the flow of electric energy through the fluid will change. The magnitude of the change in the flow of electric energy is dependent upon the degree of obstruction. Consider the case in which electric power source 10 includes a voltage source, the current flowing through the fluid will be inversely proportional to the effective resistance of the fluid over the length of fluid carrying member 12. When voids are present within the fluid in fluid carrying member 12, the effective electrical resistance between the ends of fluid carrying member 12 is above the value present when fluid substantially fills the interior volume of fluid carrying member 12. As the fluid flow is progressively obstructed in fluid carrying member 12, the effective resistance increases, thereby reducing the flow of current. Corresponding to the decrease in the flow of current, the signal generated by measuring device 14 changes as the flow of electric energy through the fluid changes. Therefore, the signal generated by measuring device 14 provides an indication of the continuity of fluid within fluid carrying member 12. The relationship between the effective resistance and the fraction of the volume inside fluid carrying member 12 filled by voids can be empirically derived or analytically estimated. Using this relationship, the degree to which fluid carrying member 12 is filled by voids can be estimated from the measured values of the parameter.

Figure 2A:
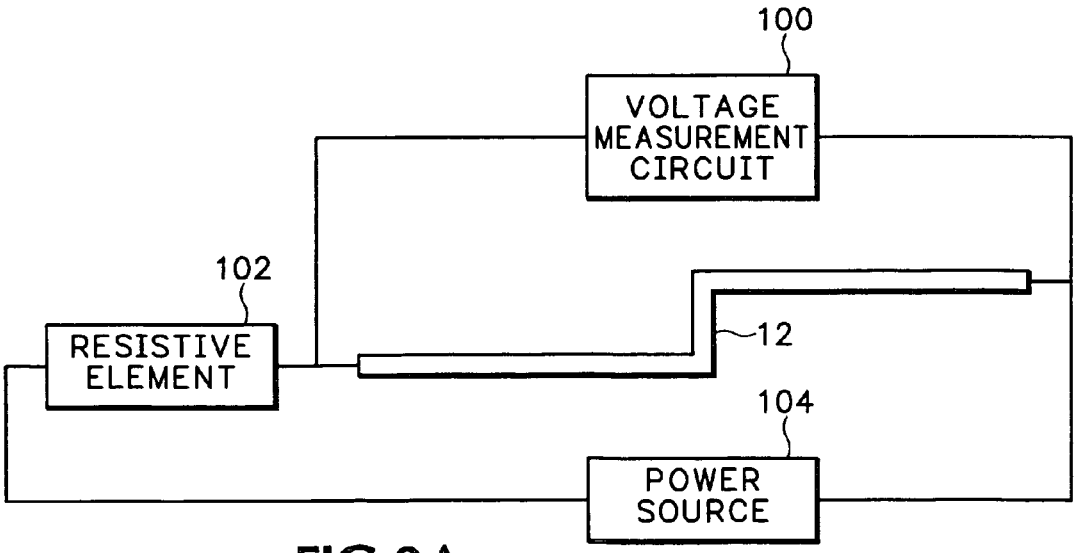
Figure 2B:
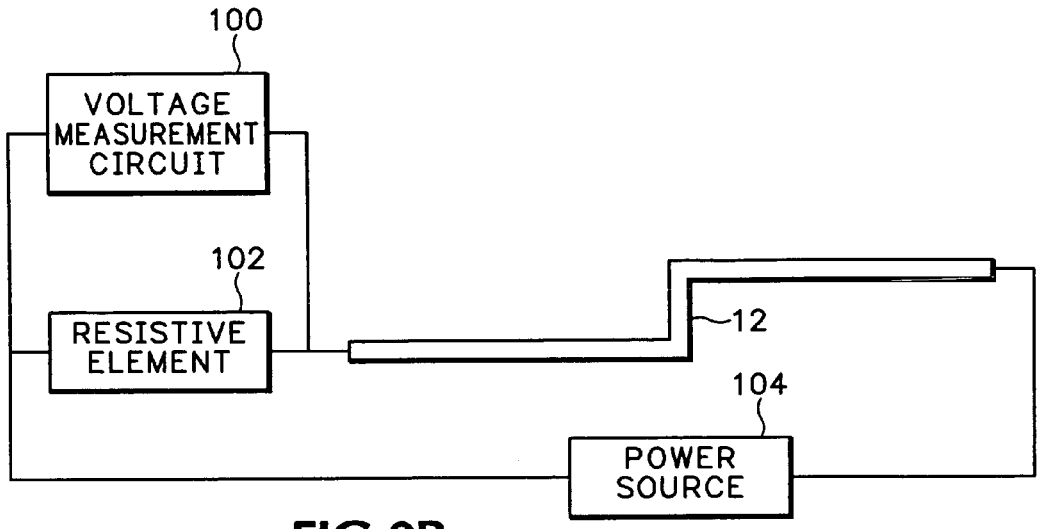
Figure 2C:
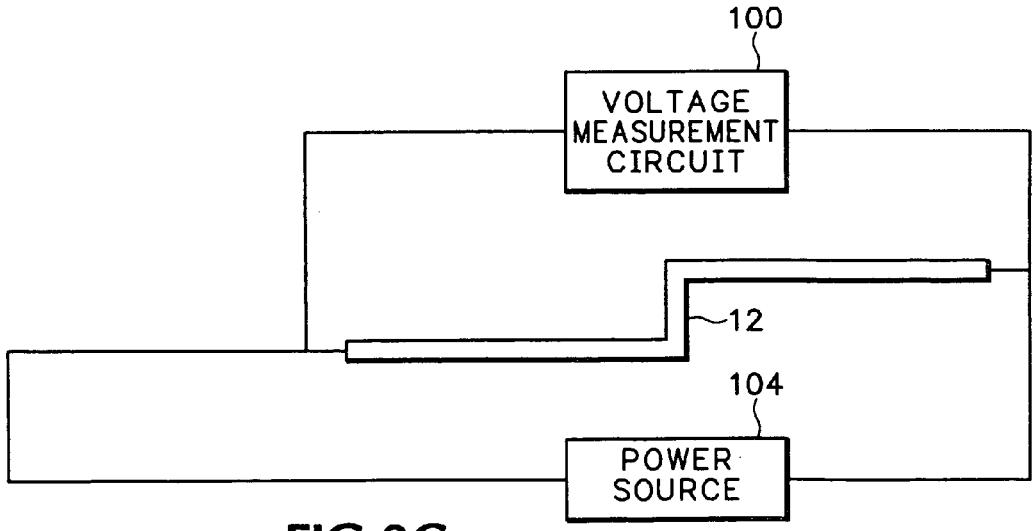

A variety of different measuring devices could be used for measuring device 14. For example, measuring device 14 could be a voltage measuring device, a current measuring device, or an electric power measuring device. In addition, the different types of measuring devices may be used in a variety of circuit configurations to measure continuity of fluid. Shown in FIG. 2A is a first configuration of an embodiment of the fluid continuity measurement apparatus using a voltage measuring device, such as voltage measurement circuit 100. Voltage measurement circuit 100 generates a signal related to the voltage between the ends of fluid carrying member 12 (with voltage measurement circuit 100 coupled between the ends of fluid carrying member 12). A resistance, such as resistive element 102, is coupled in series with electric power source 104 and fluid carrying member 12. In this embodiment of the fluid continuity measurement apparatus, electric power source 104 could be either a voltage source or a current source. The signal from the output of voltage measurement circuit 100 changes substantially proportionally to the voltage appearing across fluid carrying member 12.

Where electric power source 10 includes a voltage source and voltage measurement circuit 100 is coupled across fluid carrying member 12, an increase in the effective resistance across fluid carrying member 12 increases the voltage across fluid carrying member 12. Where electric power source 10 includes a substantially constant current source and voltage measurement circuit 100 is coupled across fluid carrying member 12, an increase in the effective resistance across fluid carrying member 12 substantially proportionally increases the voltage across fluid carrying member 12. The signal from the output of voltage measurement circuit 100 will change correspondingly.

Figure 2D:
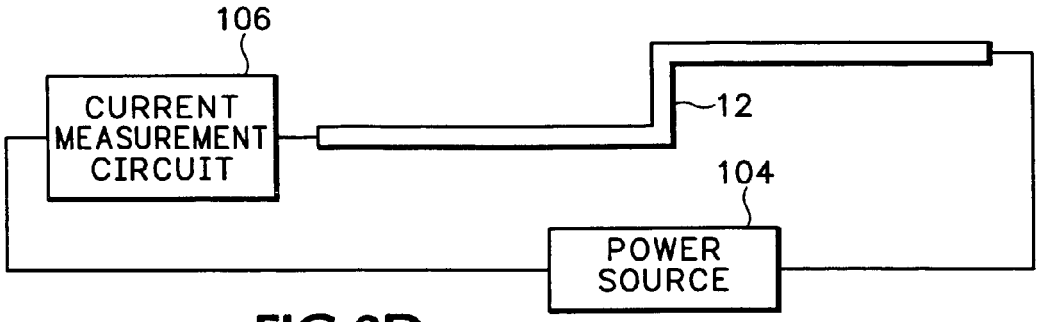
Figure 2E:
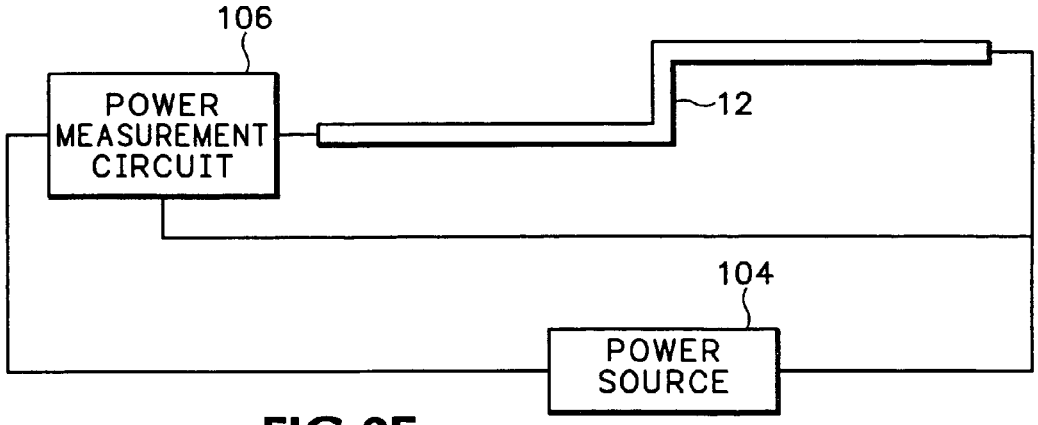
Figure 2F:
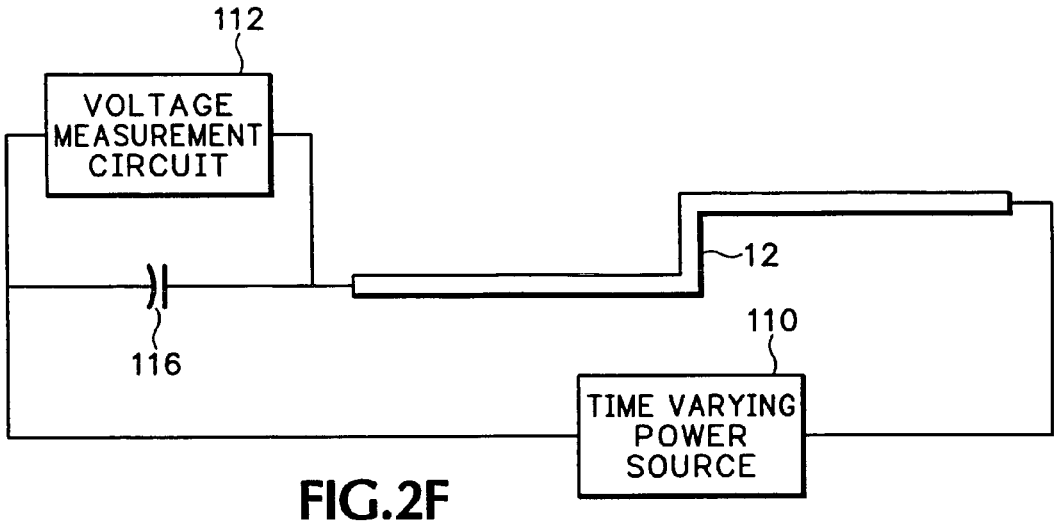
Figure 2G:
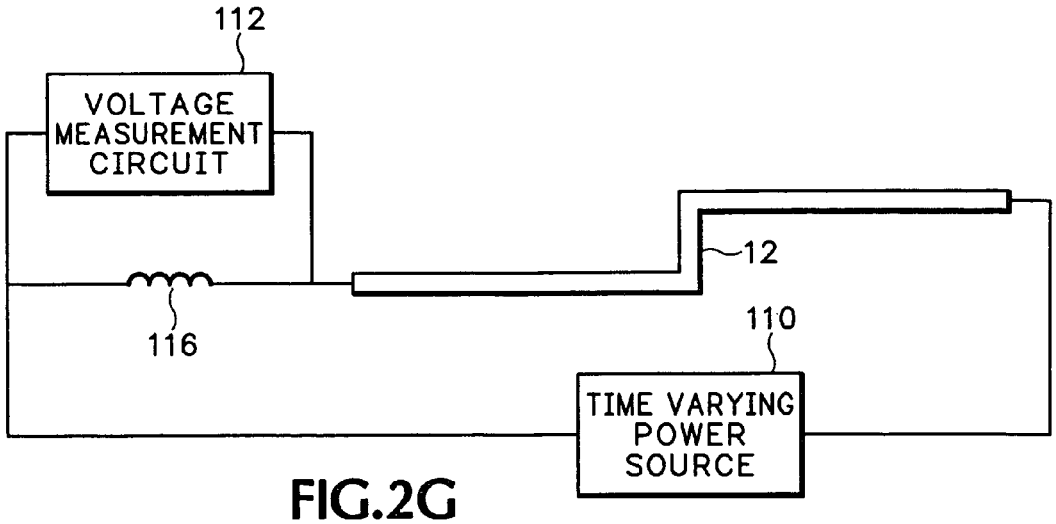
Figure 2H:
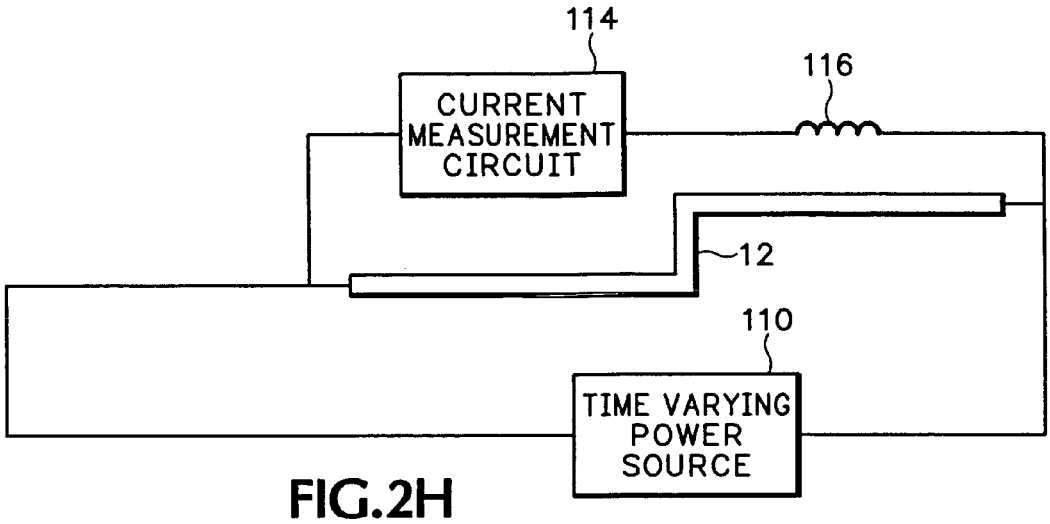
Figure 2I:
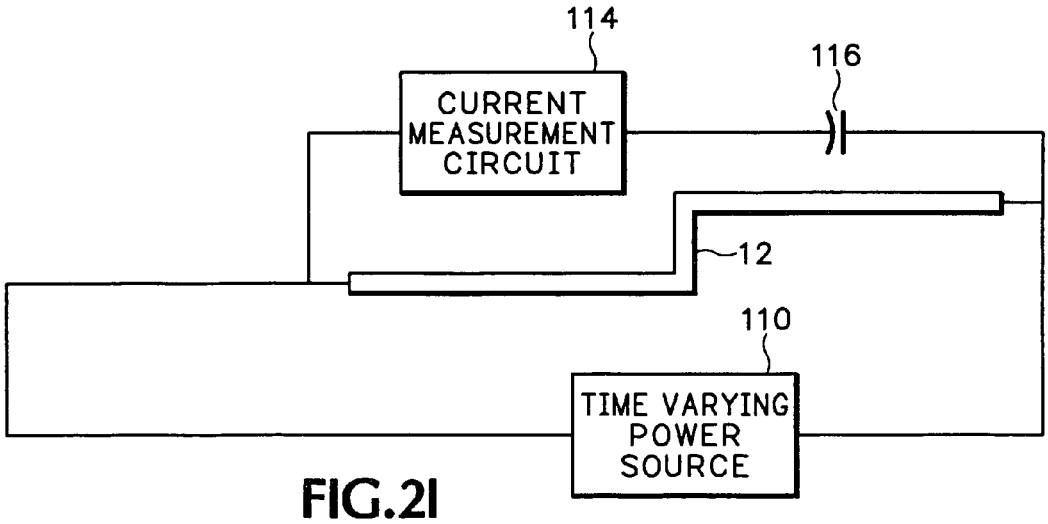

It should be recognized that alternative circuit configurations could be used to measure a change in the effective resistance across fluid carrying member 12. For example, in an alternative embodiment of the fluid continuity measurement apparatus shown in FIG. 2B, voltage measurement circuit 100 could be coupled across resistive element 102. In this alternative embodiment, electric power source 104 includes a voltage source and voltage measurement circuit 100 is coupled across resistive element 102. An increase in the effective resistance across fluid carrying member 12 will decrease the voltage across fluid carrying member 12. The signal from the output of voltage measurement circuit 100 will change correspondingly. In another embodiment of the fluid continuity measurement apparatus shown in FIG. 2C, electric power source 104 includes a current source coupled in series with fluid carrying member 12. In this embodiment, there is no series connected resistance and voltage measurement circuit 100 is coupled across fluid carrying member 12. An increase in the effective resistance across fluid carrying member 12 substantially proportionally increases the voltage across fluid carrying member 12. The signal from the output of voltage measurement circuit 100 will change correspondingly. Shown in FIG. 2D is another embodiment of the fluid continuity measurement apparatus in which electric power source 10 includes a voltage source. Current measurement circuit 106 is coupled in series with fluid carrying member 12. An increase in the effective resistance decreases the current flowing through the fluid inside of fluid carrying member 12. The signal from the output of current measurement circuit 100 will change correspondingly. Shown in FIG. 2E is another embodiment of the fluid continuity measurement apparatus in which electric power source 10 includes either a voltage source or a current source. Electric power measurement circuit 108 measures the electric power delivered by electric power source 10 to the fluid within fluid carrying member 12. An increase in the effective resistance changes the electric power dissipated within the fluid. The signal from the output of power measurement circuit 100 changes as a result of the change in the power dissipated within the fluid.

Shown in FIGS. 2F through 2I are additional embodiments of the fluid continuity measurement apparatus in which time varying electric power source 110, either a voltage source or a current source, is used to generate a waveform having characteristics related to the resistance across the fluid in fluid carrying member 12. For each of the circuit configurations shown in FIGS. 2F through 2I, time varying electric power source 110 creates a time varying waveform of voltage across the components or current through the components within the circuits having a shape dependent upon the values of the reactive components and the magnitude of the resistance across the fluid in fluid carrying member 12.

Although FIGS. 2F through 2I show the voltage measurement circuit 112 electrically coupled in a variety of configurations, it should be recognized that voltage measurement circuit 112 could be coupled across any of the components or across the fluid in fluid carrying member 12. Similarly, current measurement circuit 114 could be coupled in series with any of the components or with the fluid in fluid carrying member 12. With respect to the configuration of voltage measurement circuit 112 and current measurement circuit 114, the most useful configurations are those for which a waveform can be measured having a shape related to the resistance across the fluid in fluid carrying member 12.

Time varying electric power source 110 could include a voltage source or current source configured to deliver pulses of various possible shapes, such as a square wave pulse or a sawtooth pulse. Alternatively, time varying electric power source 110 could provide periodic signals, such as a square wave or a sine wave. Voltage measurement circuit 112 and current measurement circuit 114 could be configured to successively sample, respectively, the voltage or current waveform which they are configured to measure. Alternatively, voltage measurement circuit 112 and current measurement circuit 114 could generate an output related to the measured RMS voltage or current. This alternative would be particularly well adapted where time varying electric power source 110 generates a sinusoid.

For the cases in which voltage measurement circuit 112 and current measurement circuit 114 provide a succession of sampled values from, respectively, a voltage waveform or a current waveform, these samples could be used to compute the time constant of the circuit that gave rise to the waveforms. The resistive element of the circuit is contributed, primarily, by the resistance across the fluid in fluid carrying member 12. The value of the reactance in the circuit is contributed, primarily, by the reactive component 116 (such as capacitor or inductor) in the circuit. The values of these components are known. From the successive samples of the voltage or current waveform values, a time constant of the circuit can be computed. Because the time constant of a resistive-capacitive circuit is computed as R×C and the time constant of a resistive-inductive circuit is computed as L÷R, with the values of C and L known and having the computed value of the time constant, R (the resistance of the fluid across fluid carrying member 12) can be computed. For the cases in which voltage measurement circuit 112 and current measurement circuit 114 provide RMS values of, respectively, voltage and current in the circuit and where time varying electric power supply supplies a periodic sinusoid, the value of the resistance of the fluid across fluid carrying member 12 can be computed knowing the frequency of the sinusoid, the value of the inductance or capacitance in the circuit, and the measured RMS value of voltage or current.

Shown in FIG. 3A is a high level block diagram of an inkjet imaging device, inkjet printer 110. Inkjet printer 110 includes an embodiment of an imaging mechanism, imaging mechanism 112. Imaging mechanism 112 includes the hardware needed for forming an image on media using ink. Imaging mechanism 112 includes print heads 114 used to eject ink onto media according to signals received from print head driver electronics 116. Controller 118 receives image data defining an image through interface 120 from computer 122. From this image data, controller 118 generates print data supplied to print head driver electronics 116 corresponding to the image data. The signals supplied by print head driver electronics 116 to print heads 114 power the resistors used to eject ink from the nozzles of print heads 114.

Shown in FIG. 3B is an exemplary inkjet imaging device, inkjet printer 200, including an embodiment of the fluid continuity measurement apparatus. Fluid continuity measurement apparatus 201 is shown schematically for simplicity of illustration. In inkjet printer 200, an imaging head, such as print heads 202–208, eject ink onto media, such as paper. Print heads 202–208 are mounted onto carriage 210. During an imaging operation, carriage 210 is precisely moved along a guide, such as rail 212, across the width of paper. Print head driver electronics, electrically coupled to print heads 202–208, provide signals used to eject colorant, such as ink, from nozzles included within print heads 202–208. Typically, the colorants include cyan, magenta, yellow, and black. Reservoirs, such as ink cartridges 214–220 are mounted within inkjet printer 200 at a physically separate location from carriage 210. Each of ink cartridges 214–220 stores ink for one of the cyan, magenta, yellow, and black colors. Tubes 222–228 are coupled between each of the respective colors of ink cartridges 214–220 and the corresponding ones of print heads 202–208.

Included with each of print heads 202–208 is a small volume for storing the ink that will be ejected from the respective ink cartridges 214–220 during an imaging operation. Typically, a predetermined amount of ink is deposited into print heads 202–208 during manufacture. As imaging operations are performed, the ink initially deposited into print heads 202–208 is depleted. As ink within print heads 202–208 is depleted, ink is forced, under pressure, through tubes 222–228 from ink cartridges 214–220 into the corresponding print heads 202–208. It should be recognized that embodiments of the fluid continuity measurement apparatus would also work in systems that do not use pressure greater than atmospheric pressure in tubes 222–228. For example, embodiments of the fluid continuity measurement apparatus could be used in systems the pressure within tubes 222–228 falls below atmospheric pressure as ink is ejected from print heads 202–208.

An excessive volume of air entering print heads 202–208 will interfere with their proper operation. One failure mode of print heads 202–208 that can result from excessive air involves the unintended leakage of ink out of the nozzles of print heads 202–208. Another failure mode of print heads 202–208 that can result from excessive air includes damage to resistive elements associated with each of the nozzles in print heads 202–208. Excessive air can displace ink in regions near the resistive elements associated with each of the nozzles. The heat resulting from the application of electric power to the resistive elements without ink present can damage the respective resistive elements.

Prior to the first imaging operations performed, tubes 222–228 are filled with air. There are several techniques for handling the presence of air in tubes 222–228. In inkjet printer 200, a fluid interconnect system allows print heads 202–208 to be disconnected and reconnected to and from tubes 222–228. A first technique for purging the air from tubes 222–228 includes the use of inoperable print heads in place of print heads 202–208 during a purging operation that pushes ink into tubes 222–228 to push air out of tubes 222–228 and into the inoperable print heads. A second technique is to include additional volume within print heads 202–208 for containing air purged from tubes 222–228. After print heads 202–208 are installed into inkjet printer 200, ink is moved into tubes 222–228 which displaces air into print heads 202–208. For this alternative, print heads 202–208 are designed with additional volume to store air purged from tubes 222–228 so that air is stored ink print heads 202–208.

Consider the alternative in which inoperable print heads are used to store the air purged from tubes 222–228. In the fluid interconnect system used with this alternative, a hollow needle is pushed through a hole in a rubber membrane so that fluid in tubes 222–228 can be delivered to print heads 202–208. Occasionally, when an attempt is made to make a fluid connection between tubes 222–228 and the inoperable print heads, the rubber membrane blocks a hole in the sidewall of the hollow needle. If this occurs, air remains trapped in tubes 222–228 after the purging operation because ink is not able to move from ink cartridges 214–220 through tubes 222–228 to push air into the inoperable print heads. When a fluid connection is made between print heads 202–208 and tubes 222–228, ink will not initially flow in an unobstructed manner through tubes 222–228 because of the air remaining in tubes 222–228. Displacement of the air remaining in tubes 222–228 into print heads 202–208 will likely cause premature failure of print heads 202–208.

The other technique for addressing the air in tubes 222–228 may also not be completely effective in removing air from tubes 222–228. Air trapped in tubes 222–228 forms voids within the ink in tubes 222–228. These voids may be of sufficient size to significantly obstruct the flow of ink through tubes 222–228. Voids formed from air trapped against the sidewalls of tubes 222–228 are able to grow in size over time. Once air is trapped against a sidewall of tubes 222–228, air can diffuse through the sidewall and increase the size of the void so that ink flow through the respective tubes 222–228 is significantly reduced or stopped.

For wide variety of techniques used to address the air in tubes 222–228 (including other techniques not disclosed in this specification or those later developed), an embodiment of the fluid continuity measurement apparatus can be used to detect the presence of voids within the ink in tubes 222–228. The embodiment of the fluid continuity measurement apparatus included within inkjet printer 200 detects the presence of voids within the ink present in tubes 222–228 by measuring a parameter related to the flow of electric power through the ink for each of tubes 222–228. Included within the embodiment of the fluid continuity measurement apparatus are measurement devices 230 configured for measuring the parameter related to the flow of electric power through the ink for each of tubes 222–228. Electric power is supplied to the ink within each of tubes 222–228 by electric power sources 232. Measurement devices 230 generate signals related to the parameter for each of tubes 222–228. Controller 234 receives these signals and compares each of them to a threshold value to determine if the detected void is sufficiently large to interfere with the proper delivery of ink to the respective print heads 202–208.

Shown in FIG. 4 is a simplified representation of the connections between print heads 202–208, ink cartridges 214–220, and tubes 222–228 with the embodiment of the fluid continuity measurement apparatus. In this embodiment of the fluid continuity measurement apparatus, electric power sources 232 include current sources 300–306 electrically connected in series, respectively, with print heads 202–208, tubes 222–228, and ink cartridges 214–220. Measurement devices 230 include voltage measurement circuits 308–312 coupled, respectively, across tubes 222–228. Each of current sources 300–306 delivers a substantially constant current that flows from the respective ones of ink cartridges 214–220 through the ink in tubes 222–228 and returns to current sources 300–306 through print heads 202–208. The output of voltage measurement circuits 308–312 are coupled to analog multiplexer 314. Analog multiplexer 314 uses two bits from controller 316 to select one of the four voltage signals provide by voltage measurement circuits 308–314. The selected one of the four voltage signals is coupled to analog to digital converter 318. Analog to digital converter 318 converts the selected voltage to an eight bit digital value received by controller 316.

The voltage values generated by each of voltage measurement circuits 308–312 are directly related to the resistance of the ink volume in each of the respective ones of tubes 222–228. As the resistance of the ink in ones of tubes 222–228 increases, the voltage measure across the respective ones of tubes 222–228 will also increase. Controller 316 compares the digital value of the voltages measured for each of tubes 222–228 to a threshold value. If the digital value of the voltage exceeds the threshold, controller 316 generates a signal indicating to the user that air must be purged from the ones of tubes 222–228 having digital values exceeding the threshold. The threshold value could be empirically determined by measuring the voltage across tubes 222–228 for a range of voids within tubes 222–228. The threshold value would be set at a level corresponding to some maximum tolerable level of voids within tubes 222–228. Alternatively, if the relationship between the resulting voltage across tubes 222–228 and the voids within tubes 222–228 was well known, the threshold could be determined analytically.

Shown in FIG. 5A is a circuit that was used to measure the relationship between the volume of ink in a tube and the resulting voltage that is measured across the ink in the tube. A variable amount of ink is stored in tube 400. Electric power supply 402 is connected in series with tube 400 and meter 404. Electric power supply 402 is set to supply 15 volts. The volume of ink in tube 400 was measured by measuring the length of tube 400 filled with ink. For a tube length of 34.5 inches, the amount of ink in tube 400 ranged from 0 inches to 31 inches.

Shown in FIG. 5B is a table showing the relationship between the voltage measured by meter 404 as the amount of ink within tube 400 varies from 0 inches to 31 inches. Electric power supply 402 is configured to provide a substantially constant 15 volts. A plot of this data reveals a strong correlation to a linear relationship. As the length of tube 400 containing ink decreases, the voltage dropped across the ink in tube 400 increases. Although the distribution of ink within the tube in the test configuration is likely different than the distribution of ink that will occur when voids form within tubes 222–228, the experimentally measured data from the test configuration does demonstrate that reducing the volume of ink within the tube will increase the resistance through the ink between the ends of tubes 222–228. It should be recognized that the test configuration used to generate the data shown in FIG. 5B will yield different results depending upon factors such as the ink chemistry (which affects ink conductivity), the cross sectional area of the fluid carrying member, and the length of the fluid carrying member.

Embodiments of the fluid continuity measurement apparatus have been described in the context of a fluid carrying member adapted for carrying ink, such as cyan ink, magenta ink, yellow ink, or black ink. It should be recognized that the conductivity of the ink is related to the chemistry of the specific ink. For example, dye based inks may have different conductivity than pigment based inks. Consequently, the threshold values for detection of a void of sufficient size to interfere with the proper delivery of ink will vary depending upon the specific type of ink in use. Furthermore, although this specification makes reference to "cyan ink", "magenta ink", and "yellow ink", it should be recognized that these terms are used generically. That is, these terms refer to a variety of inks having a particular color of pigment or dye in a range of concentrations yielding a range of color intensities. In addition, although embodiments of the fluid continuity measurement apparatus are disclosed in the context of an inkjet imaging device using a CMYK color space, embodiments of the fluid continuity measurement apparatus could be usefully applied in inkjet imaging devices using other types of color spaces. Also, embodiments of the fluid continuity measurement apparatus could be used in systems that distribute other types of fluid.

As previously mentioned, embodiments of the fluid continuity measurement apparatus can be used to determine if a fluid connection has been established between ink cartridges 214–220 and print heads 202–208. Consider the embodiment of the fluid continuity measurement apparatus shown in FIG. 4. If a fluid connection has not been established between any one of ink cartridges 214–220 and the corresponding ones of print heads 202–208, the voltage appearing across the corresponding ones of tubes 222–228 will be the maximum voltage that can be generated by the corresponding ones of current sources 300–306. The voltage values measured by the corresponding ones of voltage measurement circuits 308–312 will be substantially above the threshold value. The user will then be notified that a fluid connection has not been established.

Consider the embodiment of the fluid continuity measurement apparatus shown in FIG. 4 when inoperable print heads are installed in place of print heads 202–208 for an air purging operation. Initially, the voltage measured across tubes 222–228 will be the maximum voltage that can be generated by the corresponding ones of voltage measurement circuits 308–312 because each of tubes 222–228 will be initially filled with air. As air is purged from tubes 222–228 and a continuous path of ink between ink cartridges 214–220 and the inoperable print heads is formed, the voltage measured across tubes 222–228 by voltage measurement circuits 308–312 will decrease. When the air has been substantially purged from tubes 222–228, the measured voltage for each of tubes 222–228 will reach a minimum value. When controller 316 determines (by making successive voltage measurements for each of tubes 222–228) that the voltage across tubes 222–228 has reached a minimum, then controller 316 will generate a signal to indicate to the user that the air purging operation is complete.

Another way in which an embodiment of the fluid continuity measurement apparatus could be implemented involves the use of time domain reflectometry. This type of alternative embodiment of the fluid continuity measurement apparatus would use a simplified implementation of time domain reflectometer (TDR) to propagate an electrical pulse through the fluid within fluid carrying member 12.

To create a transmission line like structure using fluid carrying member 12 and the fluid within it, a conductive sheath would be placed over the non-conductive wall of fluid carrying member 12. The somewhat conductive fluid within fluid carrying member 12 would form the center conductor of a coaxial cable. The conductive sheath would form the outer conductor and the wall of fluid carrying member 12 would serve as the insulative material between the center conductor and the outer conductor. Waves would propagate through the insulative material. The greater the conductivity of the fluid, the more ideal the resulting transmission line will be because of the reduced resistive loss within the center conductor. To create a waveguide like structure using fluid carrying member 12, the wall of fluid carrying member 12 would be formed from a conductive material. Waves would propagate through the fluid within fluid carrying member 12. The lower the conductivity of the fluid, the more ideal the resulting waveguide will be because of the reduced resistive loss within the medium through which the waves propagate.

If the termination impedance at the end of fluid carrying member 12 substantially matches the characteristic impedance of fluid carrying member 12 filled with fluid, then the magnitude of the pulse reflected back toward the TDR will be substantially zero. A void within the fluid will create an impedance discontinuity in the transmission line or waveguide. The impedance discontinuity associated with the void will cause part of the electrical energy of the incident pulse to reflect from the discontinuity and propagate back toward the TDR.

By measuring the time delay between the initiation of the forward propagating pulse and the detection of the reflected pulse, the presence of a discontinuity and its location can be determined. The location of the discontinuity would be determined from the time interval between the launch of the forward propagating pulse and detection of the reflected pulse, knowing the propagation velocity of the pulse with fluid carrying member 12. Furthermore, because a discontinuity results from both sides of the void along the length of fluid carrying member 12, reflections would occur from both the front and back sides of the void. The time difference between the detection of these reflections could be used to determine the length of the void.

It should be recognized that the TDR technique would work regardless of whether the termination impedance at the end of fluid carrying member 12 matches the characteristic impedance of fluid carrying member 12. If there was a mismatch, a reflection would be detected at the TDR at a later time then a reflected pulse resulting from a void. The time difference allows the TDR to distinguish between a void within fluid carrying member 12 and an impedance mismatch at the end of fluid carrying member 12. However, there could be simplification of the TDR if, instead of requiring the capability to differentiate between different reflected pulses, it only had to detect a reflected pulse.

The detection of a reflected pulse or the detection of reflected pulse within a window of time (depending on the termination impedance) indicates the presence of an impedance discontinuity (such as a void) with fluid carrying member 12. The magnitude of the reflected pulse is related to the magnitude of the impedance discontinuity. Using the magnitude of the reflected pulse measured by the TDR, the controller could determine whether the void is of sufficient size to indicate that an air purging operation needs to be performed.

Yet another way in which an embodiment of the fluid continuity measurement apparatus could be implemented involves the use of a power source, such as a sonic power source, to propagate power, such as sonic power, down fluid carrying member 12. A sonic wave launched down fluid carrying member 12 would be reflected from a void within fluid carrying member 12. Measurement of the time between the launching of the sonic wave down fluid carrying member 12 and the detection of the reflected sonic wave allows determination of the location of the void within fluid carrying member 12. A sonic wave would be reflected from both sides of the void along the length of fluid carrying member 12. By measuring the time difference between the sonic waves reflected from the front and back sides of the void, the length of the void could be determined.

The sonic power source could be implemented using a transducer that generates the sonic wave from the application of an electric signal. For this implementation, the transducer generating the sonic wave could also be used to detect the reflected sonic waves and provide an electric signal at the time at which the reflection is detected. Associated electronic circuitry would be used to process the electric signals corresponding to reflections and determine the location and length of the void. In addition, the electronic circuitry would be used to generate the signal that launches the sonic wave.

Although embodiments of the fluid continuity measurement apparatus have been illustrated, and described, it is readily apparent to those of ordinary skill in the art that various modifications may be made to these embodiments without departing from the scope of the appended claims.

What is claimed is:

1. A method for measuring continuity of a fluid, comprising:

applying a time varying voltage to the fluid within a member and a reactive component coupled in series with the fluid;

measuring a voltage across the reactive component; and generating an output corresponding to the voltage.

2. A method for measuring continuity of a fluid, comprising:

applying a time varying voltage to the fluid within a member and a reactive component coupled in parallel with the fluid;

measuring a current through the reactive component; and generating an output corresponding to the current.

* * * * *